US007028865B2

(12) United States Patent
Heukamp

(10) Patent No.: US 7,028,865 B2
(45) Date of Patent: Apr. 18, 2006

(54) DISPENSER FOR FLOWABLE PRODUCTS

(75) Inventor: Wolfgang Heukamp, Swisttal (DE)

(73) Assignee: RPC Wiko GmbH & Co. KG, Pulheim (DE)

( * ) Notice: Subject to any disclaimer, the term of this patent is extended or adjusted under 35 U.S.C. 154(b) by 263 days.

(21) Appl. No.: 10/353,822

(22) Filed: Jan. 29, 2003

(65) Prior Publication Data

US 2003/0168475 A1 Sep. 11, 2003

(30) Foreign Application Priority Data

Feb. 5, 2002 (DE) ..... 202 01 742 U

(51) Int. Cl.
*B65D 37/00* (2006.01)

(52) U.S. Cl. ..... 222/207; 222/257; 222/321.7; 222/383.1; 222/387

(58) Field of Classification Search ..... 222/207, 222/321.7, 383.1, 383.3, 386, 387, 321.9, 222/321.6, 256–257
See application file for complete search history.

(56) References Cited

U.S. PATENT DOCUMENTS 4,154,371 A * 5/1979 Kolaczinski et al. ..... 222/212
4,394,939 A 7/1983 Thor et al.

(Continued)

FOREIGN PATENT DOCUMENTS

| | | |
|---|---|---|
| AT | 61990 | 11/1991 |
| DE | 3725650 | 2/1989 |
| DE | 4307752 | 9/1994 |
| DE | 4430583 | 2/1996 |
| DE | 297 12 144 U1 | 11/1997 |
| EP | 0048420 | 2/1984 |
| EP | 0316759 | 5/1989 |
| EP | 0720951 | 7/1996 |

OTHER PUBLICATIONS

Patent Abstracts of Japan, vol. 2000, No. 07, Sep. 29, 2000 & JP 2000 117162 A "Matsumoto Akira", Apr. 25, 2000.

(Continued)

*Primary Examiner*—Frederick C. Nicolas
(74) *Attorney, Agent, or Firm*—Friedrich Kueffner

(57) ABSTRACT

A dispenser for dispensing metered amounts of liquid or paste-like products has a cylindrical reservoir having an open bottom and an upper end with an intake valve. A plunger is arranged axially movably in the cylindrical reservoir and closes off the open bottom of the cylindrical reservoir. A dispensing head is arranged on the upper end of the reservoir. The dispensing head has a bell-shaped dispensing pump having elastic sidewalls and a pump head with a through opening having an outlet valve. The dispensing pump together with the intake valve and the outlet valve delimits a closed pump chamber. The outlet valve is manufactured as a monolithic part of the pump neck such that with a simple working step the entire through opening of the pump neck is closable by a valve flap of the outlet valve.

8 Claims, 3 Drawing Sheets

U.S. PATENT DOCUMENTS 4,511,068 A * 4/1985 Bossina ..... 222/257
4,535,820 A 8/1985 Raines
4,771,925 A 9/1988 Stöffler et al.
4,913,322 A * 4/1990 Stoffler et al. ..... 222/207
4,936,493 A 6/1990 Foster et al.
5,704,522 A 1/1998 Orgeolet et al.
6,406,207 B1 * 6/2002 Wiegner et al. ..... 401/272

OTHER PUBLICATIONS

Patent Abstracts of Japan, vol. 1997, No. 06, Jun. 30, 1997 & JP 09 030550 A (Yoshino Kogyosho Co LTD), Feb. 4, 1997.

* cited by examiner

DISPENSER FOR FLOWABLE PRODUCTS

BACKGROUND OF THE INVENTION

1. Field of the Invention

The invention relates to a dispenser for dispensing metered amounts of liquid or paste-like products. The dispenser comprises a cylindrical reservoir open at the bottom. The open bottom end is closed by an axially movable plunger. The dispenser further comprises a dispensing head arranged on the reservoir. The dispensing head comprises a bell-shaped dispensing pump with elastic sidewalls. The dispensing pump forms a closed pump chamber together with an intake valve and an outlet valve arranged in the pump neck.

2. Description of the Related Art

For dispensing metered amounts of liquid or paste-like (pasty) products, different devices are known for pressing the product out of the reservoir and through an application opening. These devices differ significantly with respect to their configuration as well as their function.

A dispenser of the aforementioned kind is known from European patent 0 048 420 B1. The dispenser is comprised of a hollow reservoir of a cylindrical shape with an open end at the bottom end which is closed by an axially movable tracking plunger. The upper end of the reservoir has a cover with an intake valve. A dispensing head is arranged on this cylindrical reservoir and comprises a dispensing pump arranged in the dispensing head whose pump chamber is limited at the intake side and at the exit side by a check valve. A mouthpiece with an application opening is arranged downstream of the dispensing pump.

For a metered dispensing of the product to be dispensed, a downwardly acting pressure is applied onto the dispensing pump causing the dispensing pump to be compressed, the outlet valve to be opened, and the intake valve to be closed so that the product contained within the pump chamber is forced out via the application opening of the mouthpiece.

Upon releasing and subsequent relaxation and expansion of the dispensing pump, the outlet valve is closed and the intake valve opened. The under pressure or vacuum which is generated in the pump chamber when the dispensing pump expands now causes new product to be taken in from the reservoir through the intake valve of the cover wherein at the same time the plunger or the closure is moved farther in the direction toward the cover. This process can be repeated until the reservoir is empty and the tracking plunger contacts the cover.

A common feature of such dispensers is that after emptying they generally cannot be refilled but must be disposed of. Therefore, a general and important requirement in this connection is that the product "disposable dispenser" can be manufactured as inexpensively and simply as possible. This holds true, in particular, for the complex construction parts contained within the dispenser, for example, the check valves whose valve flaps are mechanically loaded and must work properly during the entire service life of the dispenser. The check valves are often positioned at locations of the dispenser that are not easily accessible so that the attachment of the valve flaps, usually by riveting, is often difficult and expensive.

SUMMARY OF THE INVENTION

It is an object of the present invention to configure the dispenser of the aforementioned kind with a headpiece whose dispensing pump is provided with an outlet valve having a valve flap that can be mounted easily and has a configuration that is as simple as possible.

In accordance with the present invention, this is achieved in that the outlet valve is manufactured as a unitary part of the pump neck, such that with a simple working step the entire upper through opening of the pump neck can be closed by a valve flap.

The dispensing pump of the dispensing head is formed as a unitary element having a bell-shape and is inserted through the bottom into the dispensing head and in the mounted state (the dispensing head is pushed onto the reservoir) forms together with the cover of the reservoir a pump chamber. The dispensing head narrows or tapers at its upper end to a neck with a circular cross-section. This hollow inner neck of the dispensing pump represents the outlet opening of the pump chamber and is used as an outlet valve by arranging a valve flap at its upper end.

According to the invention, this arrangement of the valve flap is such that the valve flap is a unitary part and covers the entire upper through opening of the pump neck so that it can function as an outlet valve.

In accordance with an advantageous configuration of the invention, the valve flap of this outlet valve is a rubber disk having a central bore which is placed onto a projecting axial pin of the pump neck. The pin, according to the invention, is a part of the dispensing pump or of the pump neck and is formed as a unitary part thereof wherein it is connected by stays to the pump neck. For the attachment of the rubber disk on the pin, the pin is provided with a peripheral groove at the level of the upper edge of the pump neck. The rubber disk engages this groove lockingly when placed onto the pin.

The final assembly step only requires to place the rubber disk with its central opening onto this pin of the dispensing pump in order to convert the outlet opening of the pump neck into an outlet valve.

When dispensing is carried out, wherein the outlet valve is open for dispensing the product, the rubber disk is curved with its outer periphery upwardly in the direction toward the mouth piece while the center of the rubber disk is secured in the peripheral groove of the pin in its original position. When returning the outlet valve into its rest position by means of the under pressure or vacuum generated in the pump chamber, the outer edge returns into its initial position and the rubber disk again rests sealingly on the pump neck.

In order to simplify the manufacture of the outlet valve even more, according to another advantageous configuration of the invention it is alternatively suggested to employ a portion of the pump neck as a valve flap.

For this purpose, the pump neck is manufactured as a unitary part with a cap which closes off the neck in the upward direction. By a separating process this cap is separated from the pump neck only partially so that the remaining unseparated portion of the cap forms a bracket and the cap remains connected to the pump neck. Since the bracket is manufactured of the same elastic material as the entire dispensing pump, the bracket operates as a hinge for the valve flap, which is formed by the initial cap of the pump neck.

The manufacture of this valve flap is thus reduced to a simple partial separating process performed on the dispensing pump which has been manufactured as a unitary part, for example, by injection molding.

DESCRIPTION OF THE PREFERRED EMBODIMENTS

Figure 1:
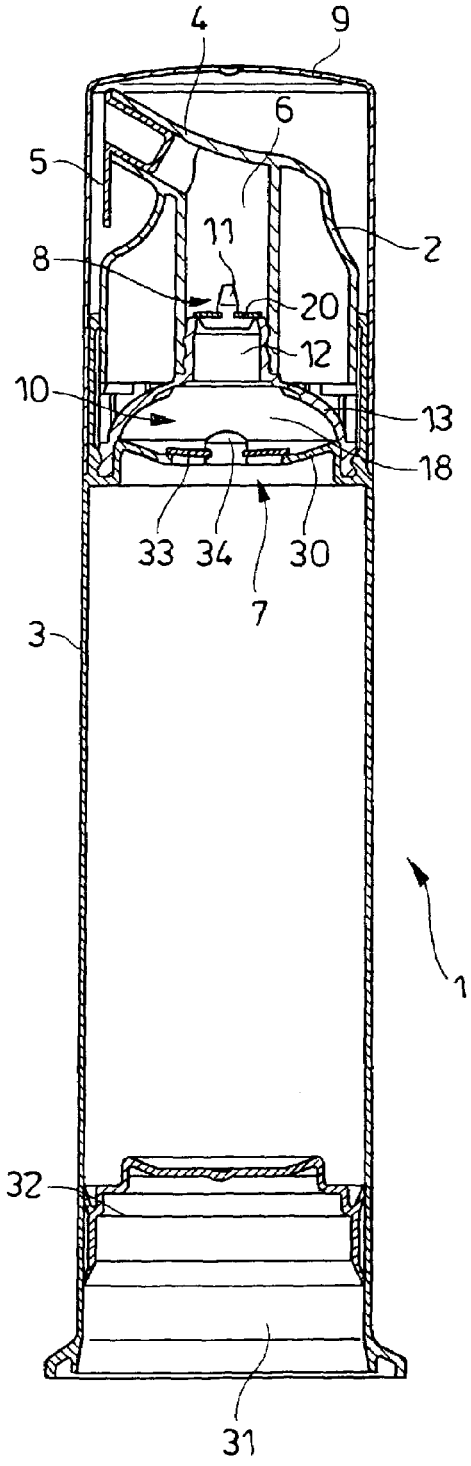
FIG. 1 shows a dispenser according to the invention in vertical section.
Figure 2:
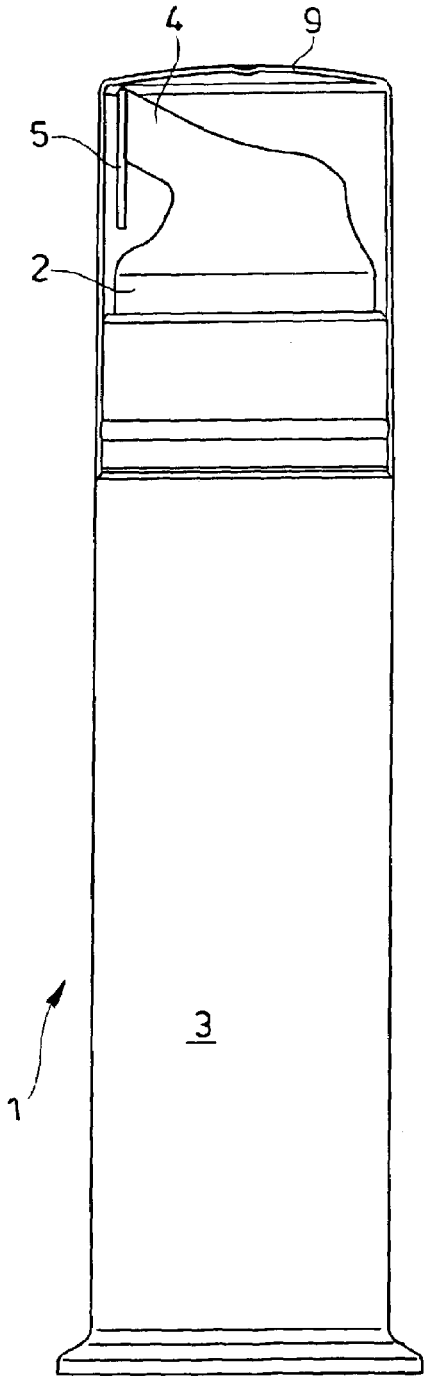
FIG. 2 shows a front view of the dispenser of FIG. 1.

FIGS. 1 and 2 show a vertical section (FIG. 1) and a front view (FIG. 2) of a dispenser 1 for dispensing metered amounts of liquid or paste-like products with a dispensing pump 10 according to the present intention.

The dispenser 1 is comprised of a reservoir (storage container) 3 with a lower open end 31 for filling the product to be dispensed into the reservoir. After completion of filling, this open end 31 is closed by a tracking plunger 32. The upper end of the reservoir 3 is delimited by a cover 30 with intake valve 7.

The dispensing head 2 is pushed onto the reservoir 3. It is comprised of a dispensing pump 10 with a bell-shaped or dome-shaped configuration having an outlet valve 8 and a dispensing channel 6 downstream of the outlet valve 8. A mouth piece 4 with application opening and a cover flap 5 are provided. The dispensing head 2 is pushed onto the storage container or reservoir 3 such that the dispensing pump 10 open at the bottom sits tightly on the cover of the dispensing container or reservoir 3 and is locked therewith so that a pump chamber 18 is formed between the dispensing pump 10 and the cover 30. The cap 9 is pushed onto the dispensing head 2 for protecting it.

The outlet valve 8 of the bell-shaped dispensing pump 10 is arranged at its open neck-shaped end where a valve flap 20 rests sealingly. According to the invention, this valve flap 20 is formed, for example, by a rubber disk with a central hole or opening 26 which is pushed onto a central pin 11 of the pump neck 12.

Figure 3:
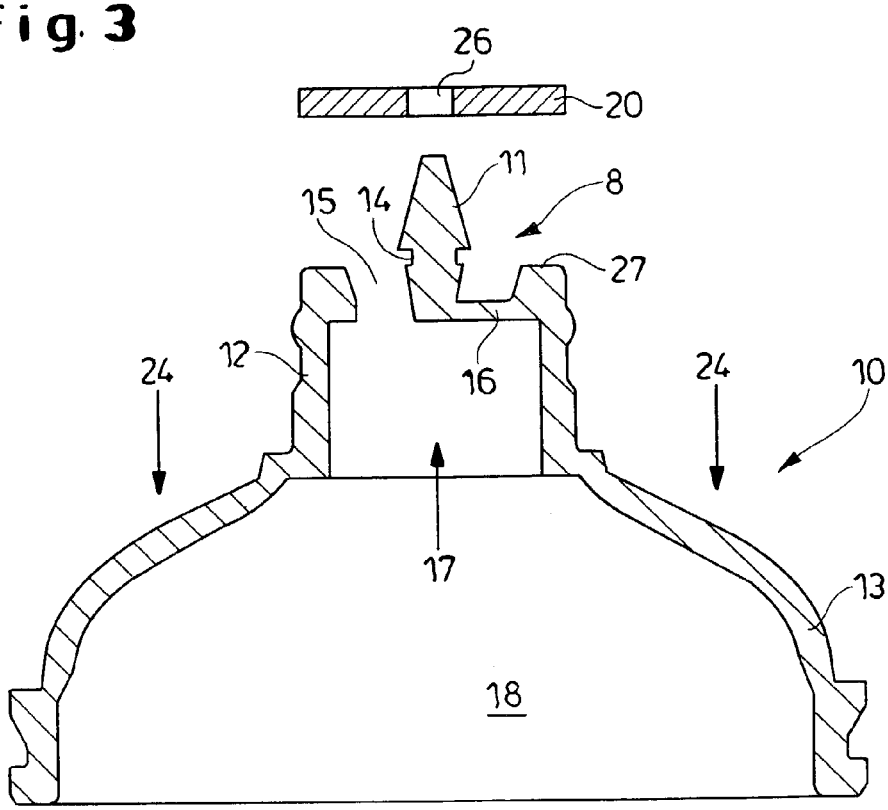
FIG. 3 shows an enlarged detail view of the dispensing pump in vertical section.

In FIG. 3, the dispensing pump 10 of FIG. 1 is shown in detail. The upper area of the pump neck 12 is provided with, for example, four stays 16 arranged in the through opening 15 and formed monolithically with the common pin 11. The pin 11 has at the level of the upper edge 27 of the pump neck 12 a peripheral groove 14. The valve flap in the form of a rubber disk 20 with a central hole 26 is pushed onto this pin 11 so that the rim of the central hole engages and locks in the groove 14 and rests sealingly against the upper edge 27. In this way, the entire upper through opening 15 of the pump neck 12 is covered.

When applying external pressure in the downward direction of arrow 24 onto the dispensing pump 10, causing the elastic walls 13 of the dispensing pump 10 to yield and the pump neck 12 to be moved in the same direction downwardly, the contents of the pump chamber 18 is pushed upwardly in the direction of arrow 17 so that the outer periphery of the rubber disk 20 curves upwardly and thus partially releases the through opening 15. The position of the central area of the rubber disk 20 remains unchanged because it is secured in the groove 14 of the pin 11.

Figure 4:
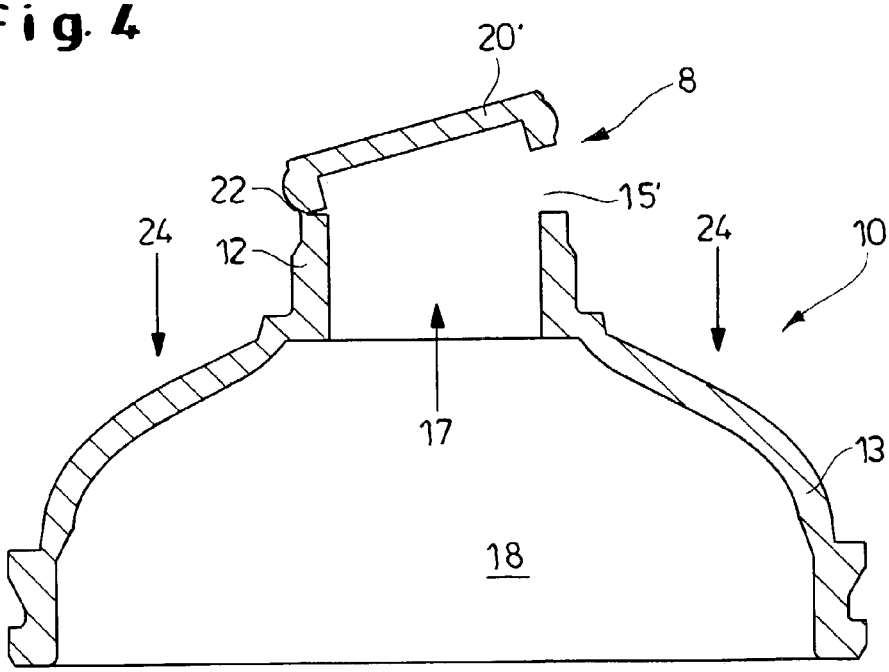
FIG. 4 shows an enlarged detail view of a further embodiment of the dispensing pump in vertical section.

In FIG. 4, a further configuration of an outlet valve 8 according to the invention is illustrated. In this alternative embodiment, only the pump neck 12 is changed while the rest of the dispensing pump 10 is identical to the preceding embodiment. By eliminating the stays 16 and the pin 11, the upper end of the pump neck 12 is smooth and provided with a pivotable valve flap or cap 20'. The pump neck 12 and the cap 20' are manufactured as a unitary part and are then separated from one another partially by a separating process such that the cap 20' is connected only across a narrow unseparated part, the bracket 22, with the pump neck 12 so as to be movable. The moveable cap 20' or valve flap thus provides a particularly simple configuration of a valve flap which seals and opens in a functionally reliable way the pump neck 12 and its through opening 15'.

Figure 6:
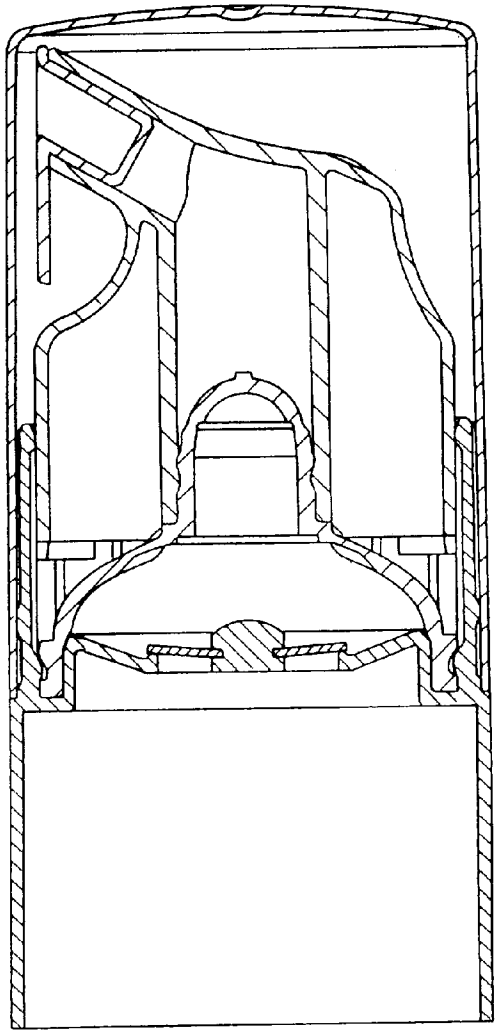
FIG. 6 shows an enlarged detail of a dispenser according to FIG. 5 with the outlet valve in the closed position.
Figure 5:
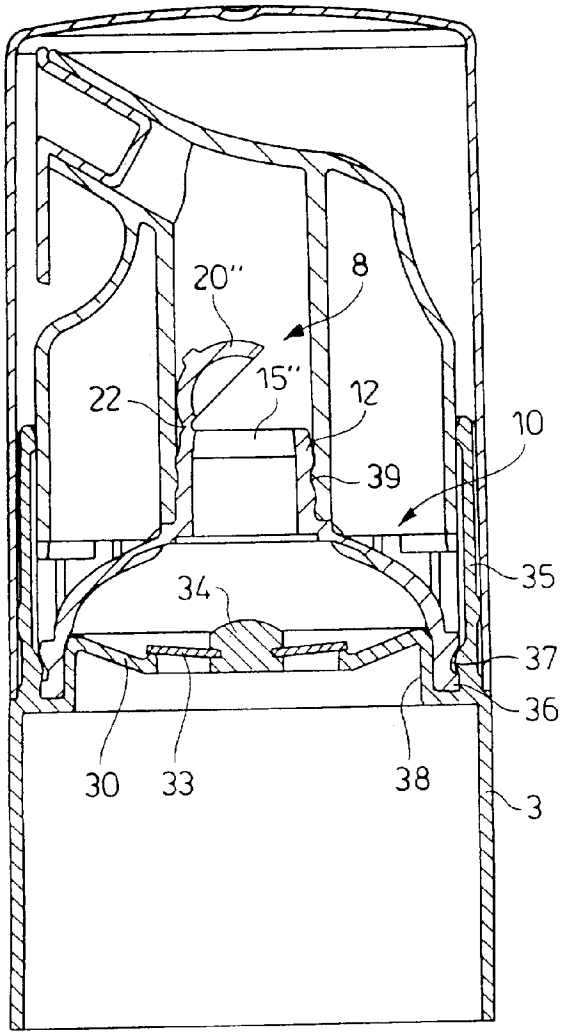
FIG. 5 shows an enlarged detail view of a dispenser with open outlet valve.

In FIGS. 5 and 6, an enlarged detail view of a dispensing head 2 of the dispenser 1 with a dispensing pump 10 is illustrated whose outlet valve 8, in analogy to FIG. 4, is provided with a dome-shaped valve flap 20", and not with a flat one, manufactured together with the pump neck 12.

FIG. 5 shows the outlet valve 8 provided with this valve flap or cap 20" connected only by the unseparated bracket 22 with the pump neck 12 in the open position, while FIG. 6 shows the closed position.

Moreover, in this enlarged illustration of the dispensing head 1 according to the invention, the rivet-shaped connection of the valve flap 33 of the intake valve 7 with the cover 30 of the reservoir 3 can be seen more clearly than in FIG. 1. In this connection, the valve flap 33 of the intake valve 7 is an elastic disk 33 provided with a central hole, preferably in the form of a rubber disk, which is pushed onto a projecting pin 34 of the cover 30, wherein the projecting head of the pin 34 (projecting past the disk 33) is deformed by a thermal deformation at one end such that the disk 33 is now secured non-detachably on the pin 34.

FIGS. 5 and 6 also show in more detail the attachment of the dispensing pump 10 with its sidewalls 13 by means of a locking connection 37 in an annular groove 36 of the reservoir 3. The annular groove 36 is formed by a reservoir extension 35 projecting past the cover 30 and a lateral rim 38 of the cover 30. The lower edge of the sidewalls 13 is pushed into the groove 36 and locked therein by a locking connection.

Because of the few and simple parts according to the inventive configuration, the dispenser of FIGS. 5 and 6 can be mounted in a simple way, for example, by means of the following step:

a) the valve flap 33 in the form of the elastic disk is pushed onto the pin 34 (rivet head), which is accessible from above when the dispensing pump 10 is not present, and, subsequently, the pin 34 is deformed;

b) the flap 20" of the pump neck 12 is partially separated from the pump neck 12;

c) the dispensing pump 10 prepared in accordance with step b) is pushed into the groove 36 of the reservoir 3 and locked therein;

d) the dispensing channel 6 of the dispensing head 2 is pushed onto the pump neck 12 and secured thereat by means of a locking connection 39.

While specific embodiments of the invention have been shown and described in detail to illustrate the inventive principles, it will be understood that the invention may be embodied otherwise without departing from such principles.

What is claimed is:

1. A dispenser for dispensing metered amounts of liquid or pasty products, the dispenser comprising:

a cylindrical reservoir having an open bottom and an upper end, wherein the upper end of the reservoir has an intake valve;

a plunger arranged axially movable in the cylindrical reservoir and closing off the open bottom of the cylindrical reservoir;

a dispensing head arranged on the upper end of the reservoir;

wherein the dispensing head has a bell-shaped dispensing pump comprising elastic sidewalls and a pump neck with a through opening comprising an outlet valve;

wherein the dispensing head together with the intake valve and the outlet valve delimits a pump chamber;

wherein the bell-shaped dispensing pump has a lower open end and the reservoir has a cover, and wherein the lower open end of the bell-shaped dispensing pump sealingly rests on the cover of the reservoir, such that the pump chamber is enclosed by the dispensing pump and the cover, wherein the intake valve is an integral part of the cover and the outlet valve is an integral part of the dispensing pump, and the outlet valve is formed integrally with the pump neck of the dispensing pump, wherein a valve flap of the outlet valve rests on the pump neck and closes off completely the through opening of the pump neck from above, wherein the valve flap is a disk having a central hole and wherein the pump neck has an axially projecting pin, wherein the disk is pushed onto the axially projecting pin of the pump neck such that the axially projecting pin is received in the central hole.

2. The dispenser according to claim 1, wherein the disk is a rubber disk.

3. The dispenser according to claim 1, wherein the pin is a part of the pump neck and is manufactured as a unitary part of the pump neck, wherein the pin comprises connecting stays.

4. The dispenser according to claim 3, wherein the pin has a peripheral groove at a level of an upper edge of the pump neck, wherein a rim of the central hole of the valve flap is locked in the peripheral groove of the pin.

5. The dispenser according to claim 1, wherein the reservoir has a reservoir extension projecting past a cover provided at the upper end, wherein the cover has a lateral rim, wherein the reservoir extension and the lateral rim define an annular groove, wherein a sidewall of the dispensing pump has a lower end inserted and locked in the annular groove.

6. A dispenser for dispensing metered amounts of liquid or pasty products, the dispenser comprising:

a cylindrical reservoir having an open bottom and an upper end, wherein the upper end of the reservoir has an intake valve;

a plunger arranged axially movable in the cylindrical reservoir and closing off the open bottom of the cylindrical reservoir;

a dispensing head arranged on the upper end of the reservoir;

wherein the dispensing head has a bell-shaped dispensing pump comprising elastic sidewalls and a pump neck with a through opening comprising an outlet valve;

wherein the dispensing head together with the intake valve and the outlet valve delimits a pump chamber;

wherein the bell-shaped dispensing pump has a lower open end and the reservoir has a cover, and wherein the lower open end of the bell-shaped dispensing pump sealingly rests on the cover of the reservoir, such that the pump chamber is enclosed by the dispensing pump and the cover, wherein the intake valve is an integral part of the cover and the outlet valve is an integral part of the dispensing pump, and the outlet valve is formed integrally with the pump neck of the dispensing pump, wherein a valve flap of the outlet valve rests on the pump neck and closes off completely the through opening of the pump neck from above, wherein the valve flap of the outlet valve is an elastic disk having a central hole and wherein the upper end of the reservoir has a cover provided with a projecting pin, wherein the elastic disk is pushed onto the projecting pin of the cover.

7. The dispenser according to claim 6, wherein the elastic disk is a rubber disk.

8. The dispenser according to claim 6, wherein the pin is thermally deformed to a rivet shape after the elastic disk has been pushed onto the pin and secures the elastic disk in a non-detachable way.

* * * * *